US011882973B2

(12) United States Patent
Kaleta

(10) Patent No.: US 11,882,973 B2
(45) Date of Patent: Jan. 30, 2024

(54) CLEANING APPARATUS

(71) Applicant: Crush It Products, LLC, Darien, IL (US)

(72) Inventor: Mark Kaleta, Darien, IL (US)

( * ) Notice: Subject to any disclaimer, the term of this patent is extended or adjusted under 35 U.S.C. 154(b) by 226 days.

(21) Appl. No.: 17/465,273

(22) Filed: Sep. 2, 2021

(65) Prior Publication Data

US 2022/0386843 A1 Dec. 8, 2022

Related U.S. Application Data

(60) Provisional application No. 63/197,746, filed on Jun. 7, 2021.

(51) Int. Cl.

| | |
|---|---|
| ***A47L 13/42*** | (2006.01) |
| ***A47L 13/38*** | (2006.01) |
| ***A47L 25/00*** | (2006.01) |
| ***A46B 9/02*** | (2006.01) |
| ***A46B 5/00*** | (2006.01) |
| ***A47L 13/40*** | (2006.01) |

(52) U.S. Cl.

CPC ..... *A47L 13/42* (2013.01); *A46B 5/00* (2013.01); *A46B 9/026* (2013.01); *A47L 13/38* (2013.01); *A47L 13/40* (2013.01); *A47L 25/005* (2013.01); *A46B 2200/3033* (2013.01)

(58) Field of Classification Search

CPC ..... A47L 13/42; A47L 13/38; A47L 13/40; A47L 25/005; A47L 11/04; A47L 11/08; A47L 11/22; A47L 11/4041; A47L 11/20; A47L 9/32; A46B 5/00; A46B 9/026; A46B 2200/3033; A46B 2200/3026; A46B 7/10

See application file for complete search history.

(56) References Cited

U.S. PATENT DOCUMENTS

| | | | | |
|---|---|---|---|---|
| 2,121,880 | A * | 6/1938 | Miller | A47L 11/33 15/48 |
| 8,117,706 | B2 | 2/2012 | Sato | |
| 2009/0077761 | A1* | 3/2009 | Kaleta | A47L 11/33 15/88.4 |
| 2009/0223006 | A1* | 9/2009 | Sato | A46B 13/001 15/52.1 |

* cited by examiner

*Primary Examiner* — Brian D Keller
*Assistant Examiner* — Abbie E Quann
(74) *Attorney, Agent, or Firm* — Nevin Carmichael Consulting (NCC-IP)

(57) ABSTRACT

A cleaning apparatus having a cleaning member movably arranged at a housing, the cleaning member having a cleaning portion for engaging a surface to be cleaned; a handle member connects with and is resiliently movable between a raised position and a lower position so that when the handle member is arranged at the raised position, a resilient member operably connecting the handle member with the housing is substantially compressed thereby applying a pressing force onto the cleaning member towards the surface to be cleaned.

17 Claims, 8 Drawing Sheets

CLEANING APPARATUS

CROSS REFERENCE TO RELATED APPLICATIONS

This application is based on and claims the priority of provisional patent application Ser. No. 63/197,746 filed on Jun. 7, 2021.

FIELD OF THE INVENTION

The invention relates to a cleaning apparatus and particularly, but not exclusively, to a manual cleaning apparatus for removing hair, dirt or dust from surfaces such as carpets, furniture, floors and other areas.

BACKGROUND OF THE INVENTION

A variety of cleaning tools or apparatuses such as, but are not limited to, brushes, mops and brooms are commonly available for removing dirt, dust, debris or the like from the ground, floors or any surfaces that require cleaning. Among the various apparatuses in the market, handheld cleaning tools such as brushes and roller cleaners are widely used for removing dirt such as pet hair or dust from clothing, carpets or furniture. Traditional roller brushes generally comprise a dust-trapping surface at the peripheral of the roller body, with the dust-trapping surface being formed of materials for removing dust such as adhesive materials or fabrics adapted to trap, pick up and/or adhere any hair, dirt or dust from the surface being cleaned.

For example, U.S. Pat. No. 8,117,706 discloses a cleaning instrument in the form of a roller brush designed for collecting dust from a surface. Particularly, the roller brush is configured for the user to grip the brush at a short handle for moving the brush back and forth on the surface while the dust-trapping surface of the roller is in contact with the surface being cleaned. Yet the cleaning efficiency of this type of roller brush is often found to be unsatisfactory as the efficiency is very much depending on the contact between the dust-trapping surface and the surface being cleaned, with such contact can easily be affected or limited by different using conditions such as operating angle by the user, especially when the surface is not entirely planar or horizontal. In addition, the manual operation in this traditional design also requires the user to be in close proximity to the surface being cleaned, such as by bending down or kneeling to thereby maintain contact between the roller and the surface. This presents difficulty to some users and renders cleaning of surfaces which are distant to the user being impractical, which is inconvenient and undesirable.

OBJECTS OF THE INVENTION

An object of the present invention is to provide a cleaning apparatus, in which the aforesaid shortcomings are mitigated or at least to provide a useful alternative.

Another object of the invention is to mitigate or obviate to some degree one or more problems associated with known hand-held cleaning apparatus such as a cleaning brush or roller brush.

The above object is met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In the first main aspect, the invention provides an apparatus for cleaning. The apparatus comprises a cleaning member movably arranged at a housing, the cleaning member comprising a cleaning portion for engaging a surface to be cleaned; a handle member arranged to connect with and is resiliently movable between a raised position and a lower position; wherein when the handle member is arranged at the raised position, a resilient member operably connecting the handle member with the housing is substantially compressed thereby applying a pressing force onto the cleaning member towards the surface to be cleaned.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figures, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In the claims hereof, any element expressed as a means for performing a specified function is intended to encompass any way of performing that function. It is thus regarded that any means that can provide those functionalities are equivalent to those shown herein.

The present invention generally relates to a cleaning apparatus for removing and/or collecting any dust, debris, hair including pet hair, dirt or the like from a surface to be cleaned such as clothing, carpets, furniture, floors or the like.

Without limited by the embodiments herein described or illustrated, the cleaning apparatus can be provided in any applicable forms, such as but not limited to, a hand-held cleaning brush, or a brush having a brush head fixedly and/or detachably connected to an extended or elongated handle or a pole for an easy holding by the user at a distance to the surface to be cleaned. The cleaning apparatus may also be provided in the form of a brush head having a connector or an adaptor for releasably connecting with a handle, such that the brush head can be easily detached and be replaced when it is worn-out. The releasable brush head may further be configured for connecting with a suitable part of another cleaning apparatus, such as but not limited to, an extendable handle or a suction pipe of a vacuum cleaner to thereby allow interchangeability of different types of brush heads for perform cleaning on different surfaces.

Figure 1:
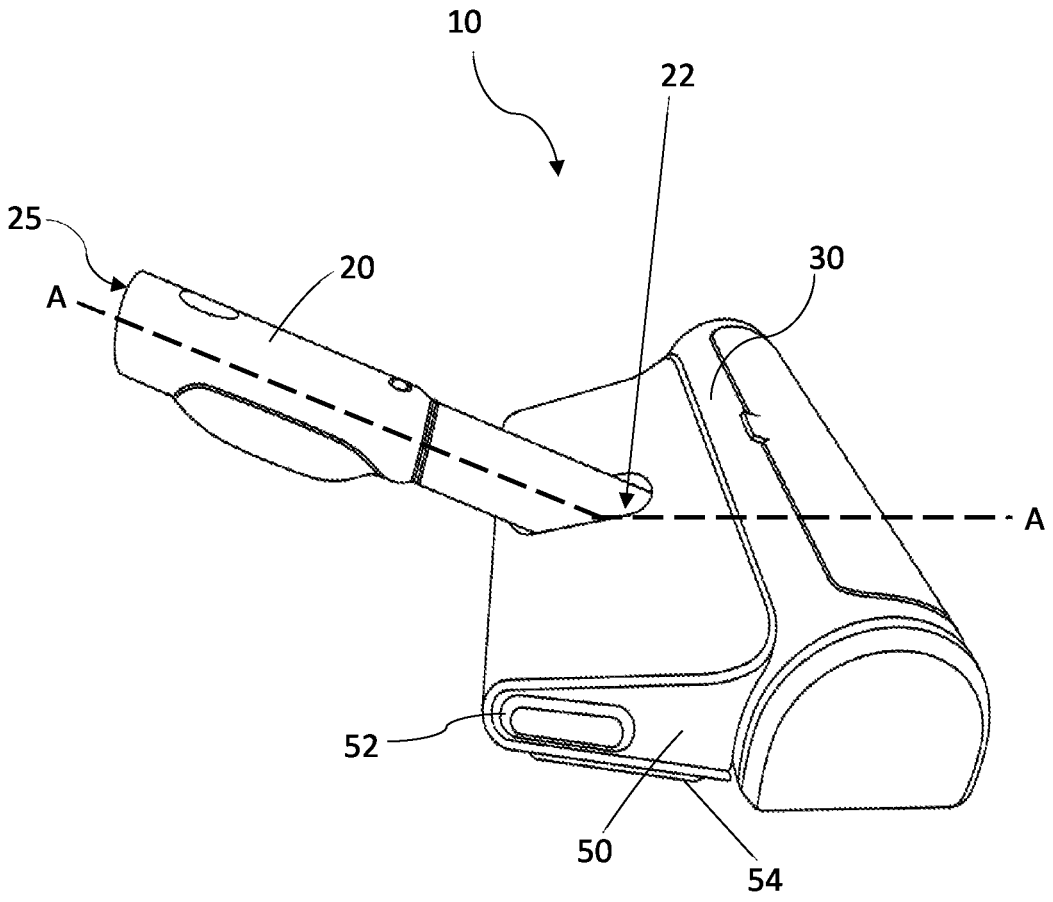
FIG. 1 is a top perspective view showing a cleaning apparatus in accordance with an embodiment of the present invention.
Figure 2:
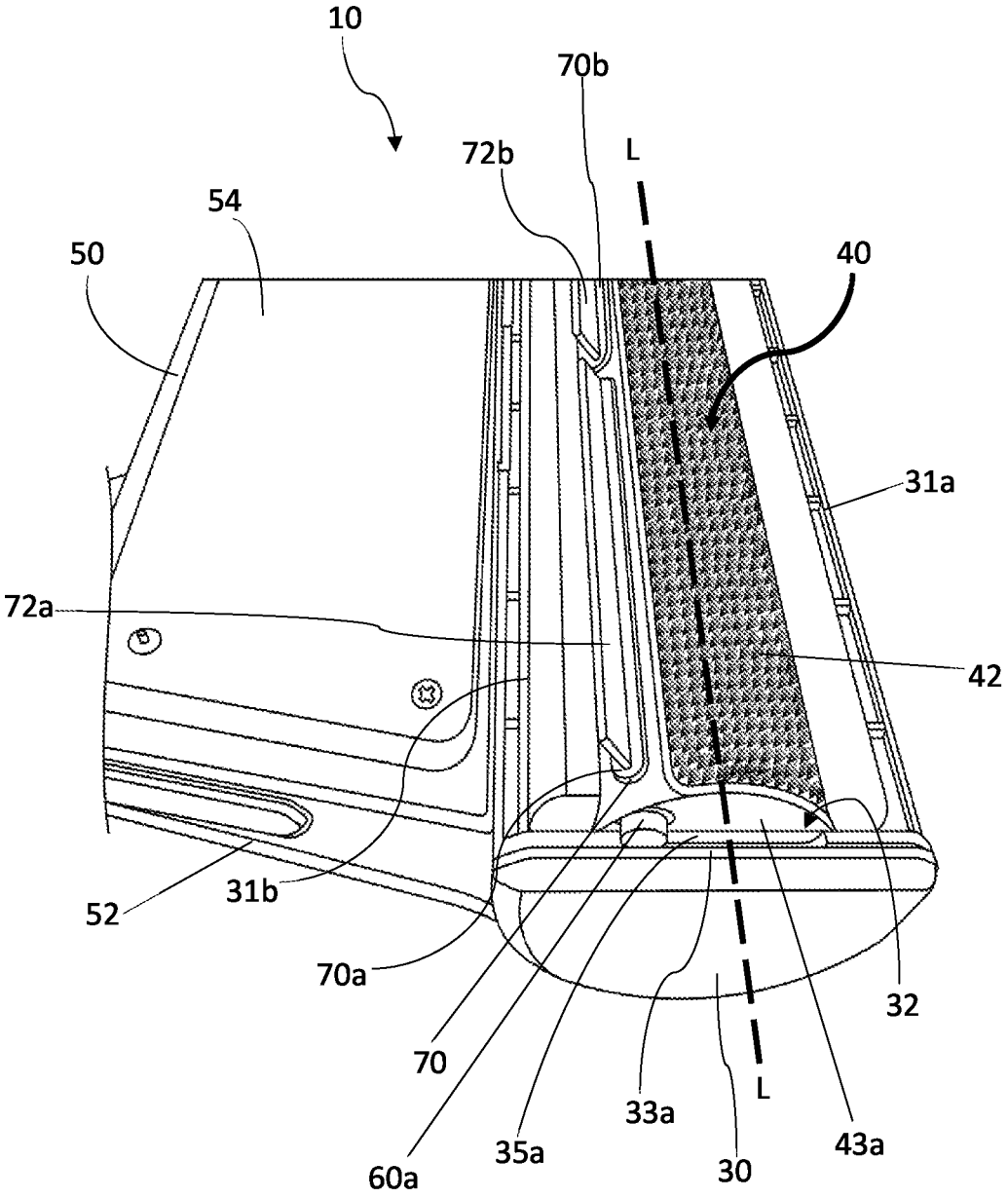
FIG. 2 is a bottom perspective view showing the cleaning apparatus of FIG. 1.
Figure 3:
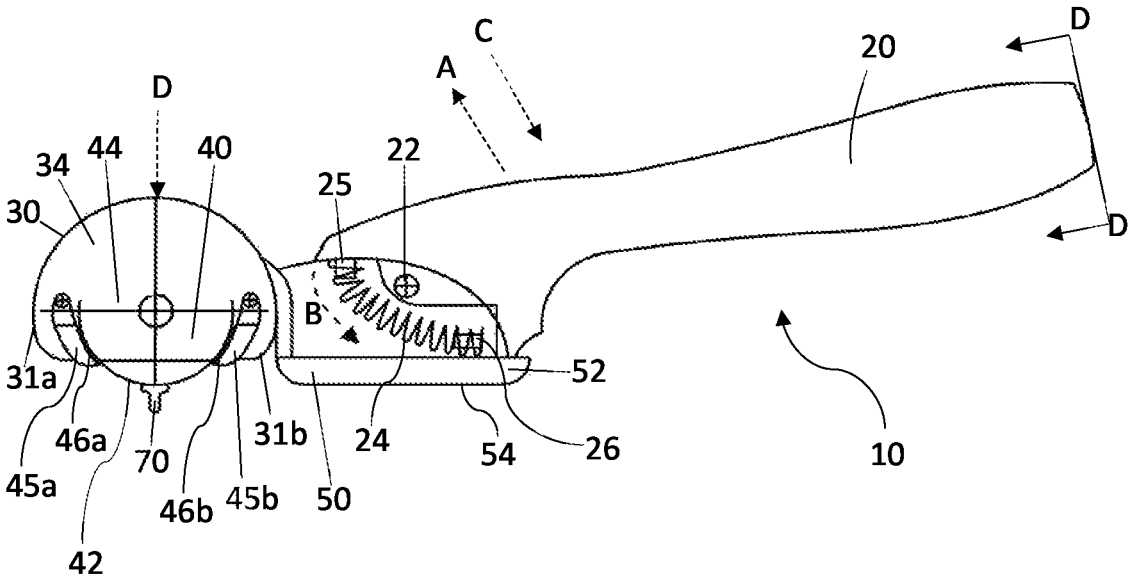
FIG. 3 is a cross-sectional view along the plane A-A as shown in FIG. 1.

Referring to FIGS. 1 to 3, shown is an embodiment of a cleaning apparatus 10 provided in the form of a cleaning brush or a brush head. The cleaning apparatus 10 is configured with a handle member 20 for gripping by the user. The handle member 20 may further comprise a connecting portion 25 for fixedly or releasably connecting a handle extension or a pole (not shown) to form an extended cleaning tool for facilitating different use conditions, such as for the user to reach a surface at a distance with the cleaning apparatus.

The handle member 20 is movably connected with a housing 30 of the cleaning apparatus 10. Preferably, the handle member 20 and the housing 30 are connected at a movable joint such as a pivot connection 22, with the pivot connection 22 being associated with a resilient member (not shown) operably connecting the handle member 20 with a housing 30. In this construction, the handle member 20 is resiliently movable at adjustable angles between a raised position, in which the handle member 20 is substantially perpendicular to a horizontal plane of the floor where the housing 30 is arranged to rest upon; and a lower position, in which the handle member 20 is substantially parallel to the floor plane. In one embodiment, the handle member 20 is movable to define an operating angle between about 0 degree, i.e. substantially parallel to the floor plane, and about 90 degree, i.e. substantially normal to the floor plane. The pivotable handle member 20 allows adjustability of operating angles of the cleaning apparatus 10 by the users according to different applications, cleaning needs and orientation of the user.

As seen in FIG. 2, the cleaning apparatus 10 further comprises a cleaning member 40 rotatably mounted at the housing 30. Preferably, the cleaning member 40 can be pivotally arranged inside the housing 30 such that it is rotatably movable about a longitudinal axis L-L of the cleaning member 30 through less than 360 degree, and more preferably, through less than 180 degree such as in a predetermined range of angles of about 10 degree to 170 degree, for example.

The housing 30 further defines a hollow cavity which substantially encases the cleaning member 40 therein, with a base opening 32 from which a portion of the cleaning member 40 being exposed for collection of dust during a cleaning. Particularly, the cleaning member 40 comprises a cleaning portion 42, such as at a peripheral surface of the cleaning member 40, for engaging the surface to be cleaned. The cleaning portion 42 may comprise or can be formed of one or more materials which are adapted to remove or collect dust and hair, such as by means of physical trapping, adhesion, or via electrostatic attraction, etc. In one specific embodiment, the cleaning portion 42 may comprise fabric materials such as felt or plush formed of cottons, wools, microfibers or the like. In one embodiment, different cleaning members 40 with cleaning portions 42 formed of materials with different dust-removing properties can be interchangeably installed at the housing 30 for cleaning different surfaces such as clothing, carpets, floors and furniture; or for removing different types of dust and dirt, etc. from said surfaces.

During a clean, the user may grip on the handle member 20 to move the cleaning apparatus 10 in a forward and backward motion while the cleaning member 40 is in contact with the surface to be cleaned. This back-and-forth motion will bring the pivoted cleaning member 40 to rotation, such as a counter-clockwise rotation when the cleaning apparatus 10 is moved forward, and a clockwise rotation when the cleaning apparatus 10 is moved backward due to the generated rotation moment, such that the cleaning portion 42 of the cleaning member 40 is adapted to engage the floor surface to trap and to remove the dust and hair from the surface.

In one embodiment, the cleaning member 40 comprises at least partially a cylindrical body such as a roller body which can be provided in the form of, for example, a full cylindrical body or a semi-cylindrical body. In one further embodiment, the cleaning member 40 may comprise a longitudinal section of a cylinder. Preferably, the cleaning member 40 comprises a substantially hollow semi-cylindrical body with an opening 44 defined by the longitudinal sectional plane which is arranged to be in spatial communication with an internal chamber 34 of the housing 30 for storage of the collected dust and hair. The cleaning portion 42 is provided at the peripheral surface of the cylindrical body of the cleaning member 40.

Providing at the housing 30 is also a dust removing member which may comprise a front dust removing member 45*a* and a rear dust removing member 45*b* arranged to abut the cleaning portion 42 of the cleaning member 40 for removing the trapped dust and hair from the cleaning portion 42. As shown in FIG. 3, the front and the rear dust removing members 45*a*, 45*b* are respectively provided between longitudinal side walls 31*a*, 31*b* and the cleaning member 40. Each of the front and the rear dust removing members 45*a*, 45*b* may respectively comprise arm 46*a*, 46*b* each having one or more sets of short bristles at an inner face thereon. Particularly, the bristles are arranged such that the tip ends of the bristles are inclined upwardly and inwardly towards the direction of the opening 44 of the cleaning member 40. The dust removing members 45*a* and 45*b* are constantly biased towards the cleaning member 40 for the arms 46*a*, 46*b* to abut the cleaning portion 42. Rotation of the cleaning member 40 thus allows the trapped dust and hair at the cleaning portion 42 to be effectively scraped off by the bristles of the dust removing members 45*as*, 45*b*.

In one embodiment, the front and rear dust removing members 45*a*, 45*b* can be integrally formed with the housing 30 with the arms 46*a*, 46*b* being resiliently flexed towards the cleaning portion 42. Alternatively, the front and rear dust removing members 45*a*, 45*b* can be pivotally connected at the respective front and rear longitudinal side walls 31, 31*b* of the housing 30, with the arms 46*a*, 46*b* being resiliently urged towards the cleaning portion 42 via one or more spring means (not shown).

In one further embodiment, the cleaning apparatus 10 may further comprise a base portion 50 having a positioning member 52 for positioning the housing 30 on the surface to be cleaned. In one embodiment, the base portion 50 is provided at a rear end of the housing 30. The positioning member 52 may comprise at least one plate member 54 which extends at an angle from the housing 30. Preferably, the plate member 54 is substantially planar and is arranged to extend horizontally from the rear end of the housing 30 and, more preferably, the plate member 54 is arranged to extend substantially parallel to a horizontal plane of the surface to be clean on which the cleaning apparatus 10 is rest upon. In the embodiment as shown in FIGS. 1-2, the positioning member 52 and/or the plate member 54 are configured in substantially a quadrilateral shape which can be, for example, a rectangular shape or a trapezoidal shape, although a person skilled in the art will appreciate that the positioning member 52 and/or the plate member 54 can be configured in any arbitrary shapes as long as the plate member 54 is substantially planar and horizontal relative to the surface to be cleaned.

The plate member 54 of the positioning member 52 is configured such that it optimises contact between the cleaning portion 42 of the cleaning member 40 with the surface to be cleaned. Particularly, the plate member 54 offers a substantially planar sliding platform to support the housing 30 such that the cleaning portion 42 can be arranged to constantly engage the surface to be cleaned at an optimum contact angle during the back-and-forth movement of the cleaning apparatus 10. The plate member 54 is thus advantageous to maximise the cleaning efficiency of the apparatus 10 by ensuring a consistent contact angle between the cleaning portion 42 and the floor surface, and for the cleaning pressure to act upon the cleaning portion 42 during cleaning to be more easily controllable, regardless of the cleaning motion of the user. This presents a significant improvement over the traditional hand-held roller brushes.

Figure 4:
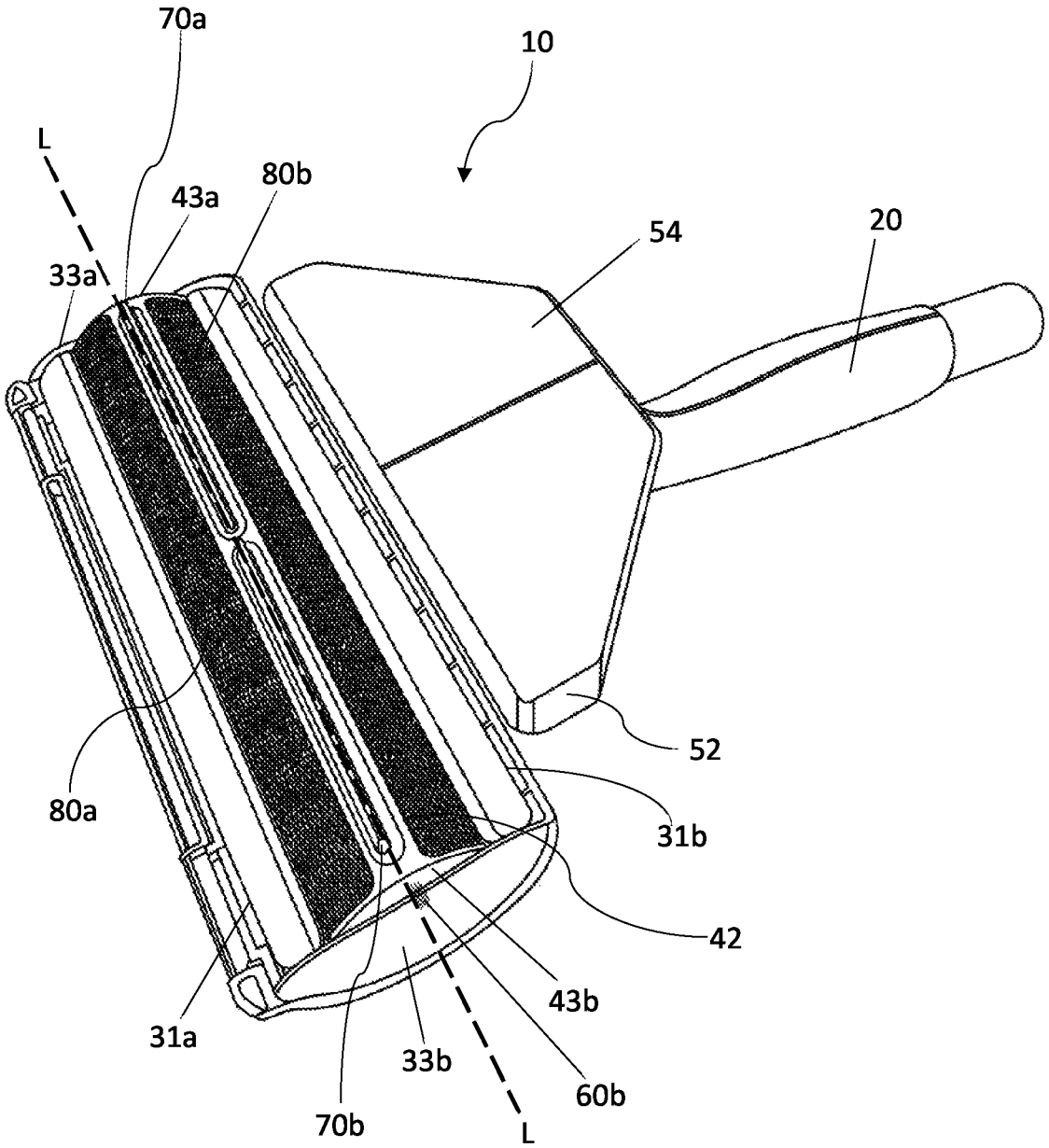
FIG. 4 is a bottom perspective view showing a second embodiment of the cleaning apparatus in accordance with the present invention.
Figure 5:
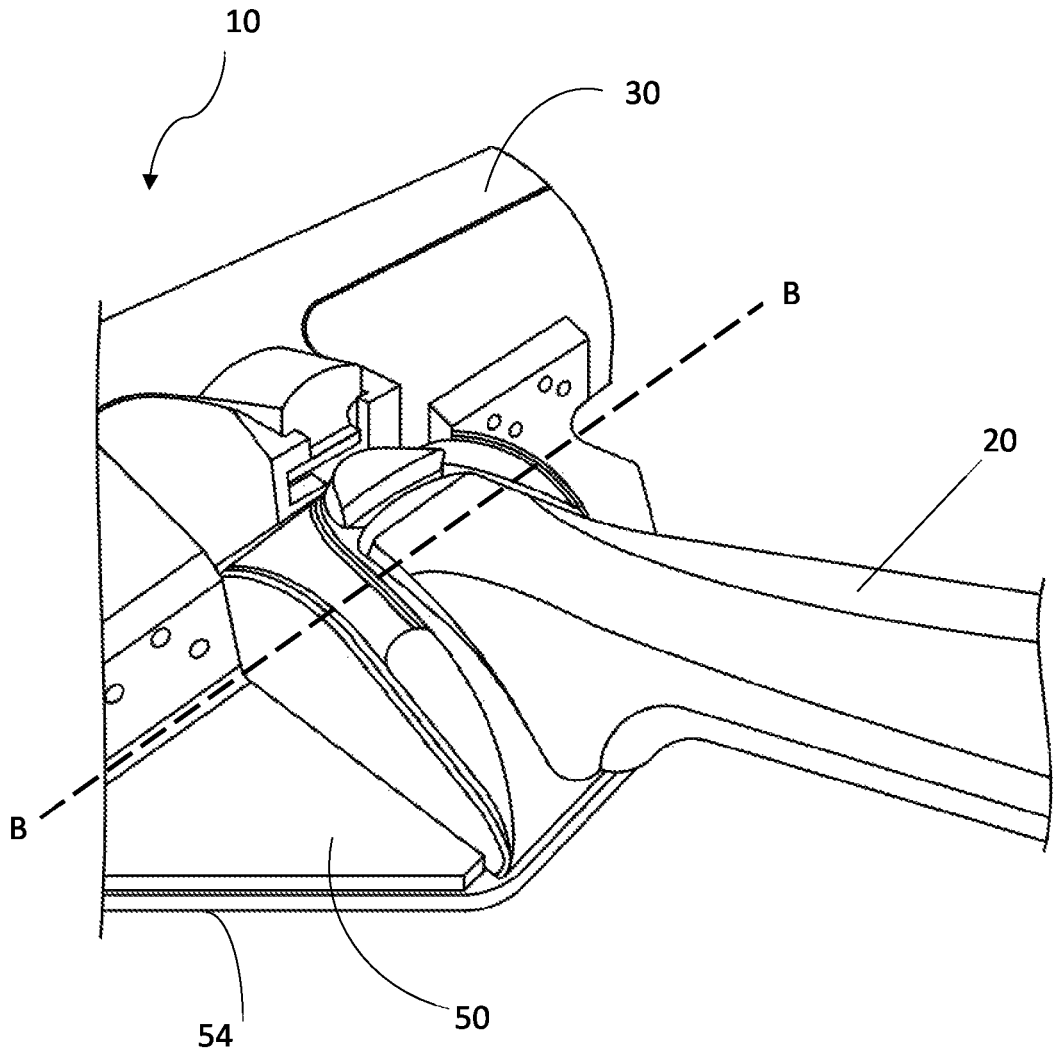
FIG. 5 shows the cleaning apparatus of FIG. 4 with the handle being arranged at a lower position.
Figure 6:
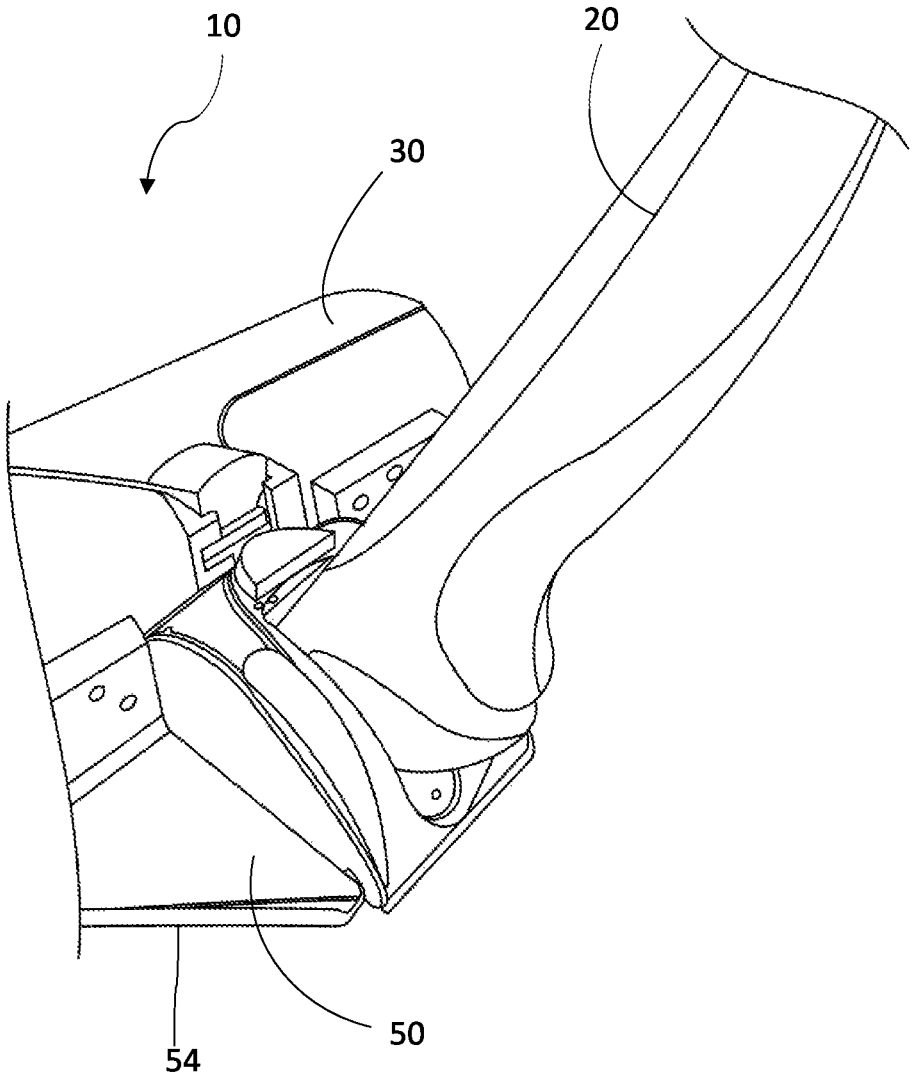
FIG. 6 shows the cleaning apparatus of FIG. 5 with the handle being arranged at a raised position.

FIGS. 4 to 6 illustrate a further embodiment of the cleaning apparatus 10 having the positioning member 52 and the plate member 54 being configured in a hexagonal shape. Again, the shape and configuration of the positioning member 52 should not be restricted to any specific embodiments described and illustrated. As long as the positioning member 52 is adapted to provide a substantially planar and horizontal surface for supporting the housing 30 at an angle such that contact between the cleaning portion 42 of the cleaning member 40 and the surface to be cleaned can be optimised, it should be encompassed by the present invention.

The cleaning apparatus 10 may further comprise one or more stopping member 60*a*, 60*b* arranged at the cleaning member 40, and preferably, at respective distal ends 43*a*, 43*b* of the cleaning member 40. In one embodiment, the stopping member 60 can be provided in the form of an extension such as a pin or a peg structure which extends away from the distal ends 43*a*, 43*b* of the cleaning member 40 towards an adjacent distal side wall 33*a*, 33*b*, respectively of the housing 30. Upon the back-and-forth movement of the apparatus 10 and thus the respective counter-clockwise and clockwise rotation of the cleaning member 40, the extension 60*a*, 60*b* located at the distal ends 43*a*, 43*b* of the cleaning member 40 will be moved to abut the respective adjacent distal side walls 33*a*, 33*b*, which prevent further rotation of the cleaning member 30, as shown in FIGS. 2 and 4. The size and the position of the stopping member 60*a*, 60*b* thus define the angle of rotation of the cleaning member 40.

The stopping member 60 can be provided in different shapes and configurations as long as it is adapted to abut the adjacent distal side walls 33*a*, 33*b* to limit the degree of rotation of the cleaning member between the two longitudinal side walls 31*a*, 31*b*. For example, the stoppering member 60 can be substantially received at a recess 35*a* provided at the adjacent distal side wall 33*a* when abutting the distal side wall 33*a*, as shown in FIG. 2. Alternatively, the stopping member 60 can be arranged to extend out from the adjacent distal side wall 33*b*, as shown in FIG. 4.

FIGS. 5 and 6 further illustrate the handle member 20 at the lower position, in which it is arranged to be substantially level or horizontal to the floor surface; and a raised position, in which the handle member 20 is arranged to be substantially perpendicular to the floor surface, respectively. In one embodiment, the handle member 20 is arranged to be pivotable about a longitudinal axis B-B substantially parallel to the longitudinal axis L-L of the cleaning member 40, with the handle member 20 being resiliently movable at adjustable angles between the lower position and the raised position via a resilient member 24. As more clearly shown in FIG. 3, the resilient member 24 can be provided in the form of a spring mean 24 with one end connected with a first pin or protrusion 25 provided at a bottom portion of the handle member 20, and another end connected with a second pin or protrusion 26 provided at the base portion 50. When the handle member 20 is raised in the direction as shown by arrow A, the resilient member 24 is compressed in the direction as shown by arrow B which generates a resistive force towards the handle member 20, which can be easily overcome by the user. The compression of the resilient member 24 also provides an additional downward force to the cleaning member 40 in the direction as shown by arrow D. This downward force which is perpendicular to the floor surface applies a constant pressure towards the cleaning member 40 so as to maintain a proper contact between the cleaning portion 42 with the surface to be cleaned.

The present invention thus overcomes a known limitation of the traditional roller brushes or similar apparatuses, as the downward pressing force during a rearward movement of a roller brush in the prior art is known to be lessen than that of during a forward movement of the roller brush and therefore, cleaning efficiency between the forward and the backward strokes during a cleaning is often not consistent. This is because, when the traditional cleaning apparatus is moved forward by the user, a rotation moment is generated to rotate the cleaning member in a counter-clockwise direction which also presses the cleaning member towards the floor surface. This downward pressing force strengthens the contact between the cleaning member and the floor surface. However, when the traditional cleaning apparatus is moved rearwardly by the user, the cleaning member is caused to rotate in a clockwise direction which also acts in the direction to raise the cleaning member from the floor surface. Contact between the cleaning member and the floor surface is thus weakened and the cleaning efficiency is compromised. The resiliently movable handle member 20 of the present invention thus offers an unexpected technical benefit to the cleaning apparatus 10, which offers an additional downward pressing force when the handle member 20 is held at the raised position in use. This additional pressing force assists a constant contact between cleaning portion 42 with the surface to be clean regardless of whether the apparatus 10 is in a forward or a rearward motion. When used together with the positioning member 52 which provides the substantially horizontal sliding platform parallel to the surface to be cleaned, the cleaning apparatus 10 presents a prominent improvement over the traditional cleaning brushes by constantly optimizing contact between the cleaning portion 42 and the surface to be cleaned, and thus maximizes the cleaning efficiency regardless of the different operation conditions.

When the user no longer holds the handle member 20 at the raised position, the resilient means 24 naturally expands against the compression which provides a force opposite to the compressive force (identified as arrow B) to the handle member 20, pushes the handle member 20 towards the lower position in the direction of arrow C.

In one further embodiment, the cleaning member 40 can be configured to comprise an engaging member 70 for engaging the surface to be cleaned to thereby enhance friction between the engaged surfaces to facilitate rotation of the cleaning member 40. Preferably, the engaging member 70 may comprise one or more members 70*a*, 70*b* arranged at the cleaning portion 42, as shown in FIGS. 2 and 4. In one embodiment, the engaging member 70 may comprise at least one protrusion 72 radially extending away from the cleaning member 40. In another embodiment, the engaging member 70 can be arranged to extend longitudinally along at least partially a length of the cleaning member 40. More particularly, the longitudinally extending engaging member 70 substantially divides the cleaning portion 42 into a first region 80*a* and a second region 80*b*, wherein the first region 80*a* is adapted to engage the surface to be cleaned in a first direction, such as a forward direction; and the second region 80*b* is adapted to engage the surface to be cleaned in a second direction, such as a rearward direction.

In use, the back-and-forth movement of the cleaning apparatus 10 will bring the cleaning member 40 into rotation through less than 180 degrees. The protrusions 72*a*, 72*b* of the engaging members 70*a*, 70*b*, when reaching the respective longitudinal front and rear side walls 31*a*, 31*b* can be configured to abut the respective longitudinal front and rear side walls 31*a*, 31*b* of the housing 30. The protrusion 70 thus further serves to limit the degree of rotation of the cleaning member 40 in addition to the stopping member 60. In one embodiment, the cleaning member 40 is configured such that the protrusion 72 of the engaging member 70 and the stopping member 60 are positioned in substantial alignment so as to abut the longitudinal side wall 31 and the distal side wall 33 of the housing, respectively, at substantially the same time for preventing further rotation of the cleaning member 40. Yet in another embodiment, the stopping member 60 can be designed to abut the distal side wall 33 prior to the abutment of the protrusion 72 with the longitudinal side wall 31 which helps to reduce the impact noise generated.

Figure 7:
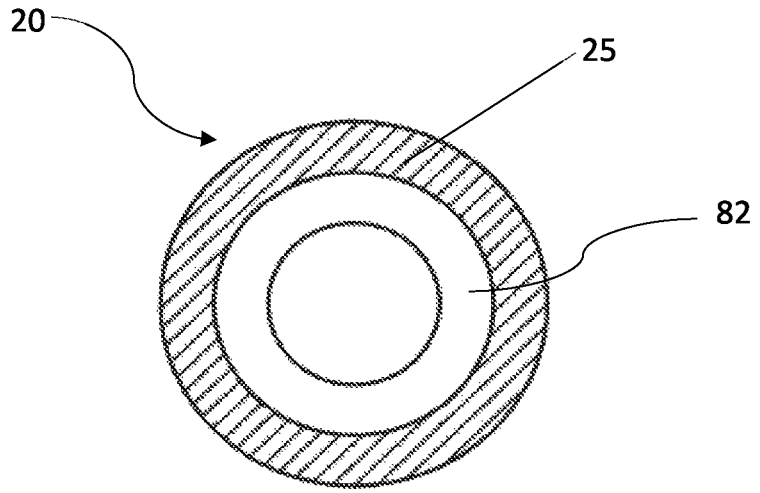
FIG. 7 is a cross-sectional view along the axis D-D as shown in FIG. 3.
Figure 8:
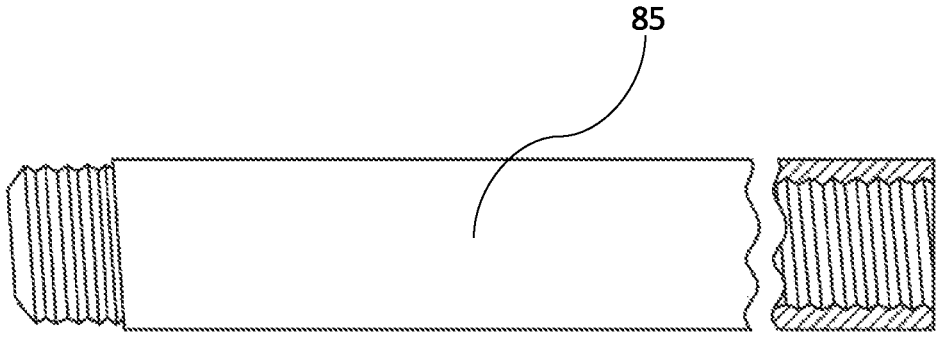
FIG. 8 shows a handle extension connectable to the handle of FIG. 7.
Figure 9:
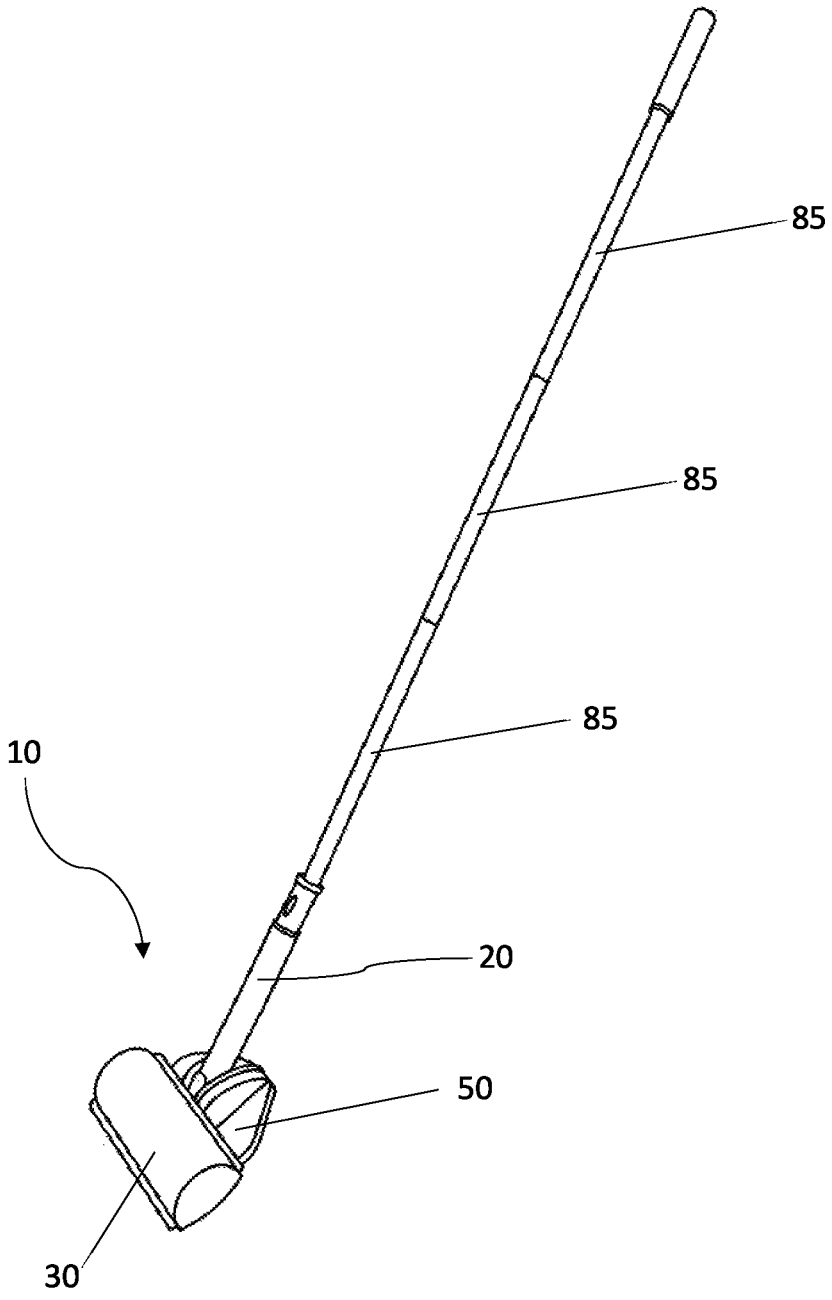
FIG. 9 shows a third embodiment of the cleaning apparatus in accordance with the present invention.

In one embodiment, the handle member 20 comprises an extendable handle having a connecting portion 82 of a connecting portion 25 for connecting at least one handle extension to the handle member 20. FIG. 7 illustrates the end view from the line D-D as shown in FIG. 3, and FIG. 8 illustrates an embodied handle extension of the present invention. As shown in the figure, the end of the handle member 20 can be screw-threaded, either internally or externally, for connecting with one or more handle extensions 85 having the corresponding screw-threaded end portion via a screw-connection. Alternatively, the handle member 20 may also be extendable via other known extending mechanism such as a telescopic extension of two or more tubular structures lockable by one or more screw-locks, for example. An embodied cleaning apparatus 10 having an extended handle is shown in FIG. 9

As described above, the cleaning apparatus 10 of the present invention can be provided in the form of a hand-held cleaning brush 10 comprising a roller brush 40 rotatably or pivotally mounted in a housing 30. The roller brush 40 is rotatable by a back-and-forth motion of the cleaning brush 10 while the roller brush 40 is at least partially in contact with a surface to be cleaned. The cleaning brush 10 may further comprise a base portion 50 preferably provided at a rear end of the housing 30. The base portion 50 comprises a positioning member 52 having a plate member 42 at its lower surface, with the plate member 42 being substantially planar and is configured to be substantially horizontal and parallel to the surface to be cleaned. The positioning member 52 is designed for positioning the cleaning brush 10, such that the roller brush 40 can be arranged to be in constant engagement with the surface being cleaned at an optimum contact angle during the back-and-forth movement of the cleaning brush 10. The hand-held cleaning brush 10 may further comprise an extendable handle 20 which is resiliently pivotable about an axis substantially parallel to the longitudinal axis of the roller brush 40. Particularly, the handle 20 is pivotable to compress a resilient member 24 operably connecting the handle 20 with the base portion 50 thereby applying a downward pressing force onto the roller brush 40 towards the surface being cleaned. This additional pressing force further assists to maintain a constant contact between the roller brush 40 and the surface being cleaned, regardless of the motion of the cleaning brush such as whether it is in a forward or a rearward movement. When used together with the positioning member 52, the additional pressing force applied by the resilient means 24 significantly enhances cleaning efficiency of the present invention over traditional roller brushes which are known to suffer from inconsistent and ineffective cleaning. Whereas the cleaning apparatus of the present invention constantly maximizes contact between the cleaning portion 42 and the surface at an effective angle during a clean, which optimizes the cleaning efficiency regardless of operation conditions and applications.

Without limited by the described embodiments, it will be readily understood by a skilled person in the art that any variations to the cleaning apparatus in terms of, for example, dimensions, configurations, constructions, designs and/or materials forming one or more parts thereof, should also be encompassed by the present invention, as long as the variations are considered suitable and applicable without departing from the inventive concept of the present invention.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art.

The invention claimed is:

1. A cleaning apparatus, comprising: a cleaning member movably arranged at a housing, the cleaning member comprising a cleaning portion for engaging a surface to be cleaned; a handle member arranged to connect with the housing and is resiliently movable between a raised position and a lower position relative to the housing; a positioning member for supporting and positioning the cleaning member on the surface to be cleaned, the positioning member comprises at least one plate member being substantially planar and extending substantially horizontally from the housing; wherein, in operation, the handle member is movable between the lower position and the raised position between an angle of about 0 degrees to about 90 degrees in respect of a horizontal plane of the surface to be cleaned, and when the handle member is arranged at the raised position, a resilient member operably connecting the handle member with the housing is substantially compressed at an angle to the horizontal plane of the surface to be cleaned, such that angular compression of the resilient member generates a downward component force perpendicular to the surface to be cleaned thereby causing a downward pressing force onto the positioning member for positioning the cleaning member towards the surface to be cleaned.

2. The cleaning apparatus according to claim 1, wherein the handle member is pivotally movable between the raised position and the lower position under the action of the resilient member.

3. The cleaning apparatus according to claim 1, wherein the plate member of the positioning member extends substantially horizontally from a rear end of the housing.

4. The cleaning apparatus according to claim 1, wherein the handle member is movable at the angle between about 0 degrees to about 90 degrees in respect of a horizontal plane defined by the plate member.

5. The cleaning apparatus according to claim 1, wherein the cleaning member comprises at least partially a cylindrical body.

6. The cleaning apparatus according to claim 5, wherein the cleaning portion is provided at a peripheral surface of the cylindrical body of the cleaning member.

7. The cleaning apparatus according to claim 6, wherein the cleaning member is substantially hollow with an opening arranged to be in spatial communication with a chamber of the housing.

8. The cleaning apparatus according to claim 1, wherein the cleaning member is pivotally connected within the housing such that the cleaning member is rotatable less than 180 degrees about a longitudinal axis of the cleaning member.

9. The cleaning apparatus according to claim 1, wherein the cleaning member comprises at least one stopping member arranged at at least one distal end of the cleaning member.

10. The cleaning apparatus according to claim 9, wherein the stopping member comprises an extension extending away from the distal end of the cleaning member towards an adjacent distal side wall of the housing.

11. The cleaning apparatus according to claim 10, wherein upon rotation of the cleaning member, the extension is adapted to abut the adjacent distal side wall of the housing thereby limiting rotation of the cleaning member.

12. The cleaning apparatus according to claim 1, wherein the cleaning member comprises an engaging member arranged at the cleaning portion.

13. The cleaning apparatus according to claim 12, wherein the engaging member comprises at least one protrusion radially extending away from the cleaning member.

14. The cleaning apparatus according to claim 13, wherein the engaging member is arranged to extend longitudinally along at least partially a length of the cleaning member.

15. The cleaning apparatus according to claim 14, wherein upon rotation of the cleaning member, the protrusion of the engaging member is adapted to abut respective opposing longitudinal side walls of the housing.

16. The cleaning apparatus according to claim 14, wherein the engaging member substantially divides the cleaning portion into a first region and a second region, wherein the first region adapted to engage the surface to be cleaned in a first direction, and the second region is adapted to engage the surface to be cleaned in a second direction.

17. The cleaning apparatus according to claim 1, wherein the handle member comprises a connecting portion for connecting at least one handle extension to the handle member.

* * * * *